United States Patent [19]

Clokey

[11] 4,112,614

[45] Sep. 12, 1978

[54] REINFORCED ARTICLES OF ELASTOMERIC MATERIAL

[76] Inventor: Arthur C. Clokey, c/o Prema Toy Co., P.O. Box 707, Topanga, Calif. 90290

[21] Appl. No.: 785,488

[22] Filed: Apr. 7, 1977

[51] Int. Cl.[2] ..... A63H 3/04

[52] U.S. Cl. ..... 46/151; 46/164

[58] Field of Search ..... 46/135 R, 152, 156, 46/163, 164

[56] References Cited

U.S. PATENT DOCUMENTS

| | | | |
|---|---|---|---|
| 2,109,422 | 2/1938 | Haughton | 46/135 R |
| 3,061,880 | 10/1962 | Weisbach | 46/135 R |
| 3,624,691 | 11/1971 | Robson | 46/151 |

*Primary Examiner*—Russell R. Kinsey
*Assistant Examiner*—Robert F. Cutting

[57] ABSTRACT

The present invention relates to facial likenesses or caricatures made of elastomeric materials and reinforced with wire in a manner such that the facial position can be manipulated to selectively alter the expression or appearance thereof.

9 Claims, 4 Drawing Figures

FIG. 1.
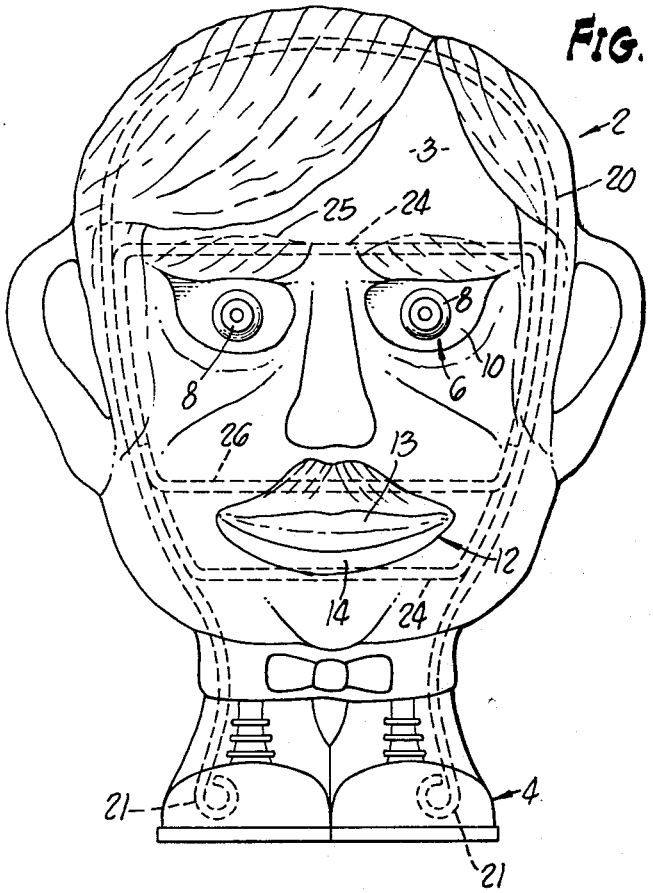
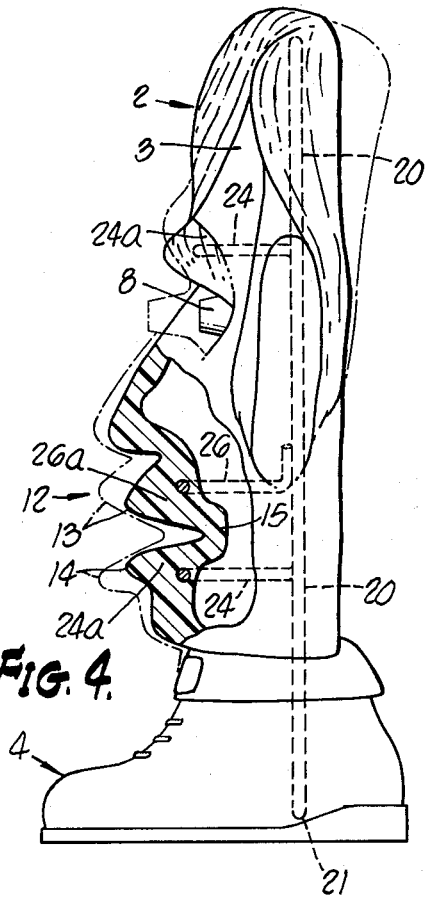
FIG. 4.
FIG. 2.
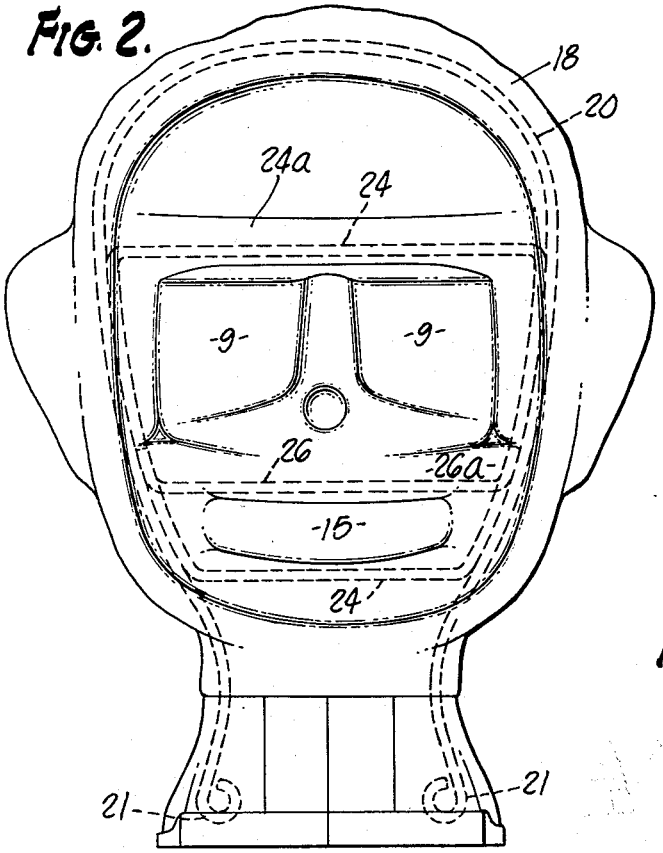
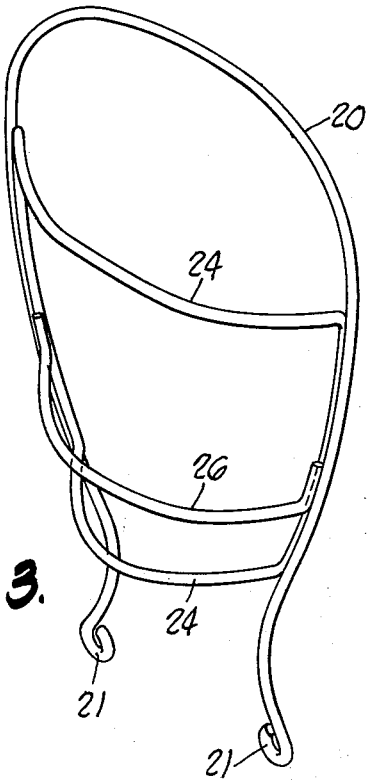
FIG. 3.

REINFORCED ARTICLES OF ELASTOMERIC MATERIAL

The present invention relates to the art of manufacture of articles such as facial likenesses or caricatures made of elastomeric resilient materials such as rubber or plastics which can be cast or molded.

BACKGROUND OF THE INVENTION

The art of casting or molding of articles made from resilient rubber or plastic materials is well developed and facial likenesses of known or fictitious characters can of course be made therefrom. While resilient materials of this type can be readily deformed, due to the elastic memory of the materials of which the caricatures are manufactured, only a single facial expression has heretofore been attainable.

It is an objective of the present invention to provide a facial likeness or caricature in which the facial expression can be selectively changed by simple manipulation of the caricature.

SUMMARY OF THE INVENTION

The present invention accordingly provides a facial likeness or caricature made of resilient material reinforced with deformable wire in thickened areas of the facial likeness or caricature whereby the facial expressions may be manipulated by bending the reinforcement.

The advantages and the objectives of the present invention are attained in the following description of a preferred embodiment.

BRIEF DESCRIPTION OF THE DRAWINGS

In the accompanying drawings:

FIG. 1 comprises a front view of a caricature constructed in accordance with the preferred embodiment and shows the external features thereof;

FIG. 2 comprises a rear view showing built-up areas in which the resilient rubber or plastic material is thickened and reinforced;

FIG. 3 is a perspective view showing the reinforcement and

FIG. 4 is a profile or side view, partly in section, of the caricature shown in FIG. 1.

DETAILED DESCRIPTION

Articles according to the present invention can be made of any suitable non-toxic resilient rubber or plastic material which can be cast in a mold. Non-toxicity of the plastic material is not an essential characteristic but is highly desirable since articles constructed according to the present invention will frequently be used as toy items where they can be subjected to use by children thus non-toxicity of each material is highly desirable.

In FIG. 1 is shown a facial caricature 2 including all of the usual facial features and in which a face 3 is shown immediately adjacent a pair of feet 4. It will of course be appreciated that any shape of the caricature can be used with or without feet adjacent to the face 3. As can be seen from FIG. 1, the eyes 6 will comprise generally cylindrical or conical projections 8 which are inset into the face 3 in a recessed area 10. Such construction enables the eyes 6 to be protruded forwardly from the face 3 to the dashed line position shown in FIG. 4 by manipulation from the rear of the article as will be described subsequently in greater detail.

As also seen in FIG. 1, the mouth 12 is shown to comprise separate upper and lower lips 13, 14 which extend forwardly and which are generally parallel to each other. Reference is here made to FIG. 4 which is the profile view, partially in section, showing the spacing of the lips 13, 14 from each other. Also shown in dashed line position in FIG. 4 is the location to which the eyes 6 and lips 13, 14 can be forwardly protruded if desired.

As seen in FIG. 2, the rear portion of the face portion of the article includes a generally concave cavity 16. The facial portion has a thickened periphery 18 extending therearound for reception of a peripheral reinforcement 20 which may be a wire. The peripheral reinforcement 20 includes two end portions each having a suitably configured anchor 21 which is embedded in the material immediately below the facial portion of the article as shown. A second reinforcement wire 24 which may be in the form of a generally rectangular loop is located in the facial portion of the article as shown to provide reinforcing at the area adjacent the eyebrows 25 and in the area adjacent the lower lip 14. A third reinforcing wire 26 is located as shown to provide transverse reinforcement for the upper lip 13.

All of the reinforcing wires 20, 24, 26 will be made of a deformable wire which preferably comprises a stainless steel annealed alloy which is corrosion free. Such wire can be readily deformed and will hold its selected shape. Preferably a non-toxic coating of high density polyethylene will be used on the wire which is embedded in the resilient material of which the article is made.

Again referring to FIG. 2, it can be seen that the areas 24*a* and 26*a* in which the wires 24, 26 respectively are embedded are constructed to be somewhat thicker or more massive than the remainder of the article in order to provide an adequate thickness of material surrounding each reinforcing wire. Also, each eye 6 is mounted on a boss 9 of relatively thin material so that depression of the boss 9 will readily cause the eyes 6 to be protruded forwardly. Similarly, a boss 15 extends in the cavity immediately behind the mouth 12 such that depression of the boss 15 will cause a change in configuration of the mouth 12.

For clarity in illustration, the reinforcement is shown separately in FIG. 3. While three separate pieces of reinforcing wire 20, 24, 26 have been shown it will be appreciated by persons skilled in the art that different patterns of reinforcement may be more appropriate for different usages. In the preferred embodiment, the reinforcing wires are welded or otherwise bonded together before they are embedded in the resilient material during the casting or molding process. Thus, the reinforcing wires will not become detached from each other but will remain capable of assuming whichever position is desired.

The type of elastomeric material, thickness thereof and type of wire must be selected together to ensure that the finished article can be readily manipulated by hand to selectively alter the facial expressions. Thus the wire must be stiff enough to hold the elastomeric material in the desired shape yet the wire must be flexible enough so that it can be easily bent and will retain its position.

By way of example only, articles have been constructed in which the size of the facial portion is approximately 4" in width and 4½" in height. The elastomeric material is about 3/16" thick in most portions except those having reinforcing wire therein wherein a minimum of about ⅛" cover exists on all sides of the wire. The wire employed was an 18 gauge stainless steel having a polyethylene coating thereon. Such articles can be easily manipulated to assume and retain desired facial expressions of infinite variety. The facial portions of the articles can be made to smile, frown, laugh, squint, stare or any combination of the above. The lips can be spread apart or pressed close together and the eyebrows can be pushed downwardly or upwardly to register anger or surprise, etc.

While the foregoing constitutes a complete description of the preferred embodiment, it will be appreciated by persons skilled in the art that modifications can be made from the preferred embodiment and the scope of protection is to be evaluated solely with respect to the attached claims.

I claim:

1. An article of elastomeric material having a facial portion in the form of a facial likeness or a caricature capable of assuming a variety of different facial expressions, said article having deformable reinforcement embedded in the elastomeric material and said facial portion and said reinforcement being capable of being manually manipulated and said reinforcement holding the elastomeric material in the selected facial expression, said reinforcement comprising a first reinforcing member extending substantially around the periphery of the facial portion of the article and a second reinforcing member extending transversely across the facial portion of the article, said second reinforcing member being affixed to said first reinforcing member.

2. An article of elastomeric material according to claim 1 wherein said reinforcement is metallic.

3. An article of elastomeric material according to claim 2, wherein said second reinforcing member provides reinforcement extending in the area of said facial portion transversely thereof substantially above the eyebrows.

4. An article of elastomeric material according to claim 3 including a reinforcing member in said facial portion extending transversly thereof below the lower lip.

5. An article of elastomeric material according to claim 4 wherein said second reinforcing member is generally in the form of a rectangular loop and provides said transverse reinforcing members above the eyebrows and below the lower lip.

6. An article of elastomeric material according to claim 5 wherein said second reinforcing member is affixed to said first reinforcing member at locations adjacent the narrow ends of said rectangular loop.

7. An article of elastomeric material according to claim 6 further comprising a third reinforcing member providing reinforcement in said facial portion transversely thereof in the area of the upper lip.

8. An article of elastomeric material according to claim 7 wherein said third reinforcing member is affixed at the ends thereof to said first and second reinforcing members.

9. An article of elastomeric material to claim 1 wherein said reinforcement comprises a wire having a non-toxic plastic coating thereon.

* * * * *